US007506757B1

(12) United States Patent
Ater et al.

(10) Patent No.: US 7,506,757 B1
(45) Date of Patent: Mar. 24, 2009

(54) STACKABLE POKER CHIP CASE

(75) Inventors: Brad D. Ater, Galloway, OH (US); Sean K. Barker, London, OH (US); Jarrod M. Zvara, Delaware, OH (US)

(73) Assignee: Triple Hook Productions LLC, Galloway, OH (US)

( * ) Notice: Subject to any disclaimer, the term of this patent is extended or adjusted under 35 U.S.C. 154(b) by 196 days.

(21) Appl. No.: 11/688,942

(22) Filed: Mar. 21, 2007

(51) Int. Cl.
*B65D 21/00* (2006.01)

(52) U.S. Cl. ..... 206/315.1; 206/509; 206/445; 220/533

(58) Field of Classification Search ..... 206/315.1, 206/445, 775, 503, 507, 508, 509, 511, 512, 206/821; 220/529, 532, 533
See application file for complete search history.

(56) References Cited

U.S. PATENT DOCUMENTS 2,364,007 A * 11/1944 Stanton ..... 312/216
3,848,358 A * 11/1974 Messmer ..... 47/69
6,752,967 B2 * 6/2004 Farina et al. ..... 422/102
6,966,450 B2 * 11/2005 Askew ..... 220/529
2005/0098469 A1 * 5/2005 Agakanian ..... 206/503

* cited by examiner

*Primary Examiner*—Jacob K Ackun, Jr.
(74) *Attorney, Agent, or Firm*—Christopher L. Parmelee; Walker & Jocke LPA

(57) ABSTRACT

At least one first poker chip case is provided which includes a case body having a cavity, an opening to the cavity, a bottom outer surface, and a case lid operative to close the opening. The case lid includes a top outer surface. The cavity includes at least one cavity wall and a plurality of divider accepting slots spaced apart along the at least one cavity wall. At least one divider is operative to slide into any one of the plurality of divider accepting slots. The cavity is operative to support a plurality of poker chips therein in stacked relation. The top outer surface and the bottom outer surface include interlocking features which are operative to co-operatively engage respectively with at least two bottom surfaces and at least two top outer surfaces of further cases placed above and under the at least one first case in stacked relation.

20 Claims, 12 Drawing Sheets

STACKABLE POKER CHIP CASE

TECHNICAL FIELD

This invention relates to an apparatus and method for organizing and transporting poker chips for a poker tournament. Specifically this invention relates to a carrying case for poker chips.

BACKGROUND ART

Card games often employ the use of circular chips. Different types of chips are often associated with different amounts of value. Different valued chips are often visually distinguishable based on color and/or indicia printed on or otherwise formed on the faces of the chip. As used herein, chips are defined as stackable game pieces with a generally cylindrical shape in which the diameter of the chip is many times greater than the thickness of the chip. Also as defined herein, each chip includes a longitudinal axis which is parallel to the thickness of the chip and perpendicular to the diameter of the chip. A stack of chips corresponds to two or more chips placed adjacent to each other in series with their longitudinal axes generally aligned.

Also, although the overall shape of the chip may be a relatively thin cylindrical shape, it is to be understood that the surfaces of chips may or may not be smooth. For example, chips may include raised or indented markings, graphics and other indicia thereon. Also, the edges of the chips may include textured, grooved, or other types of non-smooth surfaces.

One popular type of card game that employs the use of chips is poker. Poker may be played with a plurality of different variations of poker rules. Some forms of poker have become sufficiently popular that poker tournaments are held involving many players (e.g., 20 or more for a small tournament) playing many rounds of poker games to determine a champion poker player. Due to the large number of people that may be involved, the amount of time it takes to set up a poker tournament can extend over one or more hours.

Much of the preparation time for such tournaments involves counting out sets of chips and arranging the chips to facilitate distribution among the players. As the players arrive before the tournament starts, additional sets are counted and stored while other preparations are ongoing. For example, the tournament director or host may assume that he/she will have twenty players participating in the tournament and will begin to count out the chips for that number of players. Starting with a particular type or value of the chips (e.g., white chips) the host will count equal stacks of the pre-determined quantity of the chips and place those stacks on a table or counter. The host will then move to the next type or value (e.g., color) of chips, counting out those chips into equal stacks and placing one stack next to each of the previously counted stacks. This process of counting and stacking chips will be repeated until all types or values (e.g., colors) have been counted, stacked, arranged in sets of different types or values (e.g., different colored stacks) of chips.

Once the chips have been counted, the next step may include placing the stacks of chips into separate plastic bags for distribution to the players. The chips typically do not remain in perfect stacks in the bags and must be re-stacked by each player as they are placed on the poker table at the start of the tournament.

The time necessary to count, stack, bag, and re-stack different types or values of chips can consume large amounts of time. As a result, there exists a need for a method of setting up one or more poker games which is more efficient.

DISCLOSURE OF INVENTION

It is an aspect of one or more embodiments of at least one invention described herein to provide at least one apparatus and/or method capable of making the setup of one or more card games more efficient.

It is a further aspect of one or more embodiment of at least one invention described herein to provide at least one apparatus and/or method capable of decreasing the amount of time needed to set up a poker tournament at a poker game location.

Further aspects of one or more embodiments of at least one invention described herein will be made apparent in the following Best Modes For Carrying Out Invention and the appended claims.

The foregoing aspects of one or more embodiments of at least one invention may be accomplished by an apparatus that includes at least one case capable of storing one or more stacks of poker chips. In an embodiment, the apparatus may include at least one first case. The at least one first case may include a case body including a cavity therein. The cavity may include at least one cavity wall and a plurality of divider accepting slots spaced apart along the at least one cavity wall. The cavity is operative to support a plurality of poker chips therein in stacked relation. Chip dividers are operative to slide into any one of the plurality of divider accepting slots to separate stacks of chips placed in the cavity.

In addition, the case body may include an opening to the cavity. Also the apparatus may include at least one case lid operative to close the opening to the cavity. In an exemplary embodiment the lid may include a portion of the cavity as well. Thus when the lid is in a closed position with respect to the case body, a stack of chips may extend in both the portion of the cavity that extends into the case body and the portion of the cavity that extends into the case lid. In an embodiment, the case lid may be in removable connection with the case body. In other embodiments the case lid may be in hinged connection with the case body.

In an embodiment, a top outer surface of the case lid and the bottom outer surface of the case body may include interlocking features. These interlocking features may be operative to co-operatively engage respectively with at least two bottom outer surfaces and at least two top outer surfaces of further cases placed above and under the first case in stacked relation.

Another embodiment may include a method directed to using the above described cases to set up at least one card game. The method may include a step of providing a plurality of the cases described previously. The method may also include, for at least one case, a step of inserting at least one divider into a slot of the at least one case. In addition, the method may include a step of inserting at least one stack of poker chips into each case. Also the method may include a step of stacking at least three pairs of the cases to form a stack of cases. For each pair of cases, the cases may be positioned in side by side relation. Also, each pair of cases may be stacked below or above at least one other pair of cases in an orientation in which each pair of cases is rotated 90 degrees about a vertical axis with respect to the pair of cases at least one of immediately thereabove and immediately therebelow.

In these described embodiments, at least one of the slots in each case may be positioned a first common distance from at least one end of the case body. When two or more different types of chips are to be used during a card game, the step of inserting at least one divider into a slot may include, for each one of at least two cases, inserting at least one divider into the slot positioned the first common distance from the at least one end of the respective case body. The step of inserting at least one stack of poker chips into each case may include inserting a stack of poker chips on each side of the divider in the at least two cases such that the chips on one side of the divider are of a different type than chips on a second side of the divider.

Different types of chips may include different visual features usable to distinguish one type of chip from another. Such different visual features for different types of chips may include one or more of different colors, different markings, and different surface features. Each different type of chip typically represents a different amount of money, points, shares, or any other unit of value.

In an exemplary embodiment, when one or more dividers are placed in corresponding common slots in multiple cases, the distance between multiple dividers in each case, or the distance between a divider and a wall in the cavity of each case, may be substantially the same size from case to case such that the same maximum number of chips of uniform thickness may be inserted therein. As a result, each case may be quickly filled with a maximum number of chips between corresponding dividers and/or walls, and the resulting number of each type of chip in each case will match from case to case without the need to count each chip inserted into each case.

In an exemplary embodiment, the method may include transporting the cases as a stack to a poker game location. Such a poker game location may include a poker tournament in which numerous rounds of poker games are played using chips provided in the described cases.

The method may include issuing at least one case to each poker player. The cases issued may include the at least two cases in which the dividers are located in corresponding slots in each case, and the same number and type of chips are stacked on each side of the divider. As a result, each of the cases issued to the poker players may be configured identically to ensure that each player receives the same number of each type of chip. The player may (if desired) leave his/her chips in the case and remove chips as needed during one or more rounds of poker games. When the lid of a case is open, the portion of the cavity that extends in the lid itself may be used to support stacks of additional chips won during game play.

In an embodiment, cases may be prepared with the appropriate number and type of chips prior to transporting them as stacks of cases to a poker game location. For example, the steps of providing the cases, inserting one or more dividers, inserting one or more stacks of chips, and stacking the cases may be done at a location remote from the poker game location.

By setting up the cases prior to traveling to the poker game location, the amount of time needed to prepare for the poker tournament at the poker game location may be significantly reduced. Rather than spending large amounts of time counting stacks of chips at the poker game location during the time immediately before the tournament begins, the cases may simply be unstacked and handed out to players. Since many sets of cases may be configured with the same number and type of chips before the tournament begins, cases may be issued to players without the need to remove and count the chips in the cases prior to issuing the cases to the players.

In an exemplary embodiment, each row of cases in a stack of cases may include a set of three cases in side by side relation. Each set of three cases may be stacked below or above at least one other set of three cases. Also, in this described embodiment, each set of three cases is rotated 90 degrees about the vertical axis with respect to the set of three cases at least one of immediately thereabove and immediately therebelow. A stack may include three or four sets of three cases. For example, a stack with three vertical rows (with three cases side by side in each row) will include nine cases and a stack with four vertical rows (with three cases side by side in each row) will include twelve cases.

In an exemplary embodiment, the method may include placing the cases as a stack into a bag or other container. The bag or other container may be of sufficient size to hold additional poker tournament items adjacent the stack. The method may include transporting the cases as a stack inside the bag or other container to a poker game location.

In an exemplary embodiment, to provide slots for accepting dividers, each case body may include at least one set of a plurality of spaced apart projections in operative connection with the at least one cavity wall. Each slot may extend between adjacent pairs of the spaced part projections. In an exemplary embodiment, the cavity includes a bottom inner surface, and the case body includes two sets of the plurality of spaced apart projections positioned on opposed sides of the bottom inner surface. The slots in the two sets of projections are aligned, such that the divider is capable of sliding into and being supported by aligned pairs of the slots positioned on opposed sides of the bottom surface. In an exemplary embodiment, the projections are positioned in the cavity such that a cylindrical poker chip is not capable of sliding into the divider accepting slots. As a result, the projections bounding the slots will not extend between adjacent chips in a stack of chips.

In an exemplary embodiment, the interlocking features on the top outer surface of the case lid and the bottom outer surface of the case are operative to hold a stack of cases together and resist horizontal forces from urging cases to horizontally move relative to each other. For example, the top outer surface is operative to co-operatively engage with the bottom outer surfaces of at least two cases placed in side by side relation on top of the at least one case lid. In addition, the interlocking feature of the bottom outer surface is operative to co-operatively engage with the top outer surfaces of at least two cases placed in side by side relation under the case body.

In an embodiment in which each row of a stack of cases includes three cases in side by side relation, the top outer surface is operative to co-operatively engage with the bottom outer surfaces of three cases placed in side by side relation on top of the at least one case lid and the interlocking feature of the bottom outer surface is operative to co-operatively engage with the top outer surfaces of three cases placed in side by side relation under the case body.

In an embodiment, the interlocking features include at least one raised projection. The at least one raised portion of at least one first case may be operative to resist lateral movement of at least one raised portion of at least one other case stacked at least one of below or on top of the at least one first case. Also, in an embodiment, the interlocking features may include at least one raised portion and at least one recessed portion. The at least one raised portion of the at least one first case is operative to project in at least one recessed portion of at least one other case.

As will be appreciated, the foregoing objects and examples are exemplary, and embodiments need not meet all or any of the foregoing objects and need not include all or any of the exemplary features described herein. Additional aspects and embodiments within the scope of the claims will be devised by those having skill in the art based on the teachings set forth herein.

BEST MODES FOR CARRYING OUT INVENTION

Figure 1:
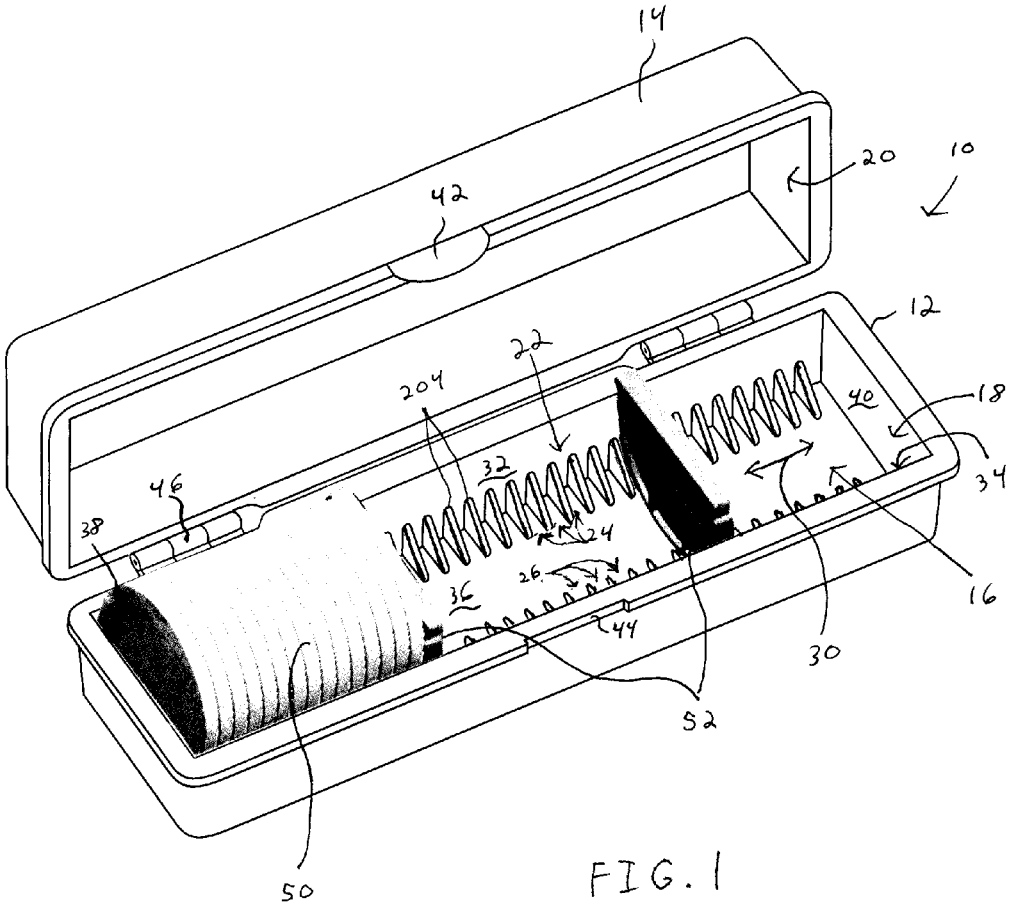
FIG. 1 is a perspective view representative of an embodiment of a stackable chip case.

Referring now to the drawings and particularly to FIG. 1, there is shown therein an embodiment of an apparatus that is operative to hold and organize chips for use with playing card games such as poker. In this described embodiment, the apparatus includes at least one case 10. The case may include a case body 12 and a case lid 14. The case also includes at least one cavity 16, operative to receive a plurality of stacked chips 50 therein.

In this described embodiment, a first portion 18 of the cavity may extent into the case body, while a second portion 20 of the cavity may extend into the lid. When the lid is closed on the case body, the lower portions of the stack of chips may extend into the portion of the cavity in the case body, while the upper portion of the stack of chips may extend into the portion of the cavity in the case lid. However, in alternative embodiments, the cavity may extend only into the case body and the lid may serve only as a cover without including a portion of the cavity.

In these described embodiments, the portion 18 of the cavity extending in the case body 12 may include inner cavity walls 22 which bound the cavity. The inner cavity walls may include an inner bottom surface 36. The inner cavity walls may also include two inner side walls 32, 34 along opposed sides of the bottom surface 36 and extending parallel to the longitudinal axis 30 of the case. In addition, the inner cavity walls may include two inner end walls 38, 40 along opposed sides of the bottom surface 36 and extending perpendicular to the longitudinal axis 30 of the case.

In the described embodiment, the case body may include a plurality of divider accepting slots 24 spaced apart along one or both of the inner side walls 32, 34 of the cavity. For example, as shown in FIG. 1, the case body may include two sets of aligned divider accepting slots 24, 26 located on opposed side walls 32, 34 of the cavity. Each corresponding pair of aligned divider accepting slots (24, 26, on opposed side walls of the cavity) are operative to receive a removable divider 52. One or more dividers may be selectively slid into any of the opposed and aligned pairs of divider accepting slots along the length of the case body. The dividers server to separate stacks of chips of different types (e.g. different colors).

Figure 2:
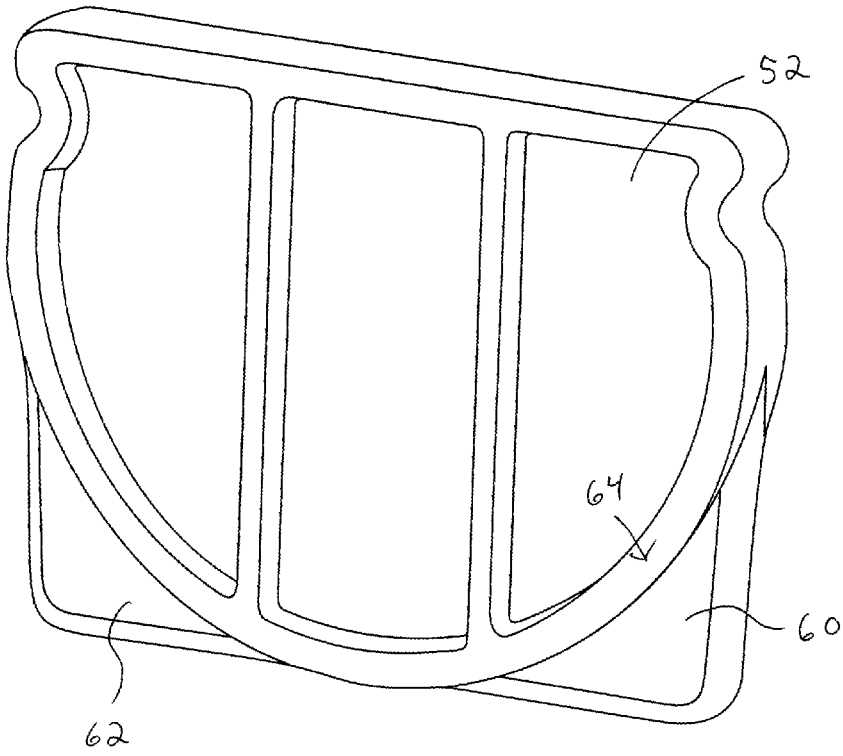
FIG. 2 is a perspective view representative of an embodiment of a divider adapted for insertion into the case.

The FIG. 2 shows an example of a divider 52. Here the divider includes a generally rectangular shape. The lower corners 60, 62 of the divider may be relatively thinner than the portions 64 of the divider adjacent the lower corners 60, 62. However, it is to be understood that in alternative exemplary embodiments, portions 64 of the body of the divider adjacent the corners 60, 62 may have a thickness which corresponds to or is less than the thickness of the corners 60, 62.

In one exemplary embodiment, the case may have a size to include 35 pairs of aligned divider accepting slots. In this embodiment, the case may hold up to 44 standard sized poker chips in a single stack when no dividers are included in the case. However, it is to be understood that in alternative exemplary embodiments, the described case may have a different size with a different number of divider accepting slots and may be operative to hold a different number of standard sized poker chips or chips in other sizes.

In this described embodiment, the thicknesses of the lower corners of the divider correspond to the widths of the divider accepting slots, to enable the corners to slide into the slots. In an embodiment, the size of the corners of the dividers and the width of the slots may be configured to enable the dividers to be capable of being placed into and out of the slots using finger pressure. However, the tightness between the corners of the divider and the walls of the slots may be sufficient to prevent the divider from falling out of a pair of slots when the case is upside down.

In addition to the features described above, the case may include other features which make the case more useful for storing and transporting chips. For example, as shown in FIG. 1, the lid may include an integral latch 42 operative to engage with a slot 44 in the case body when shut. Also the lid and case body may be connected by one or more hinges 46. In addition, it is to be understood that in alternative exemplary embodiments, the lid may not be in hinged connection with the case body, but instead the lid may correspond to a cover that removably engages with the case body.

Figure 3:
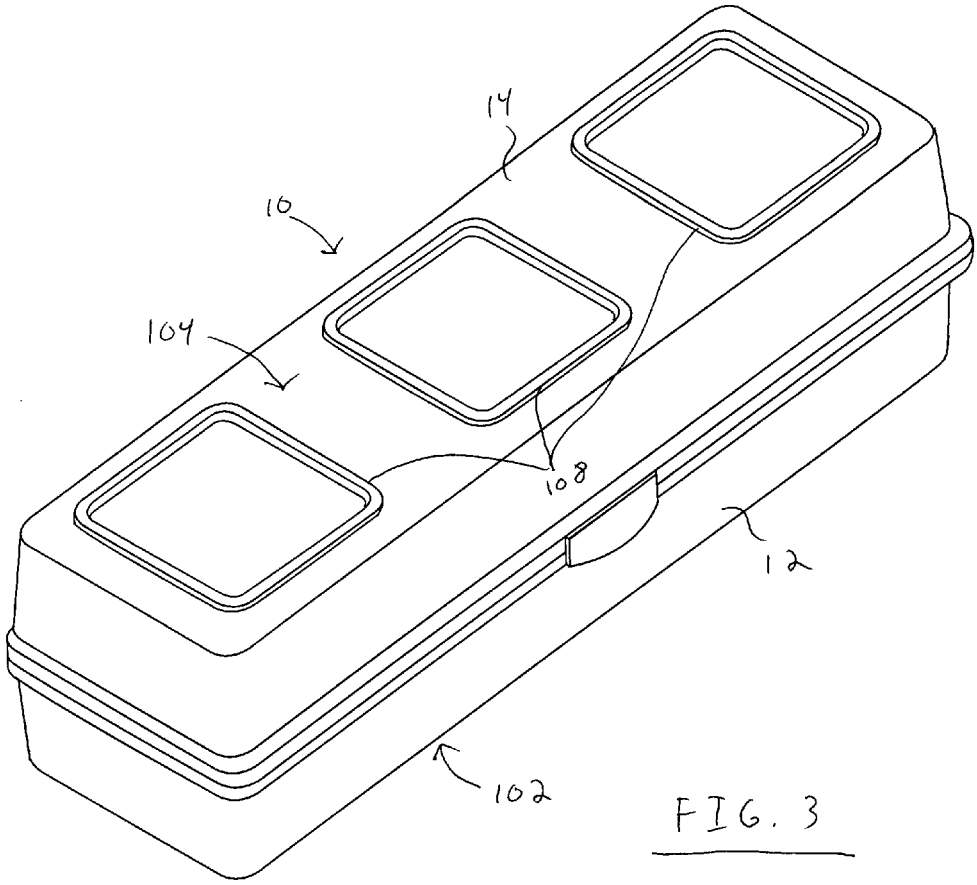
FIG. 3 is a perspective view showing the top of the lid of the case.
Figure 4:
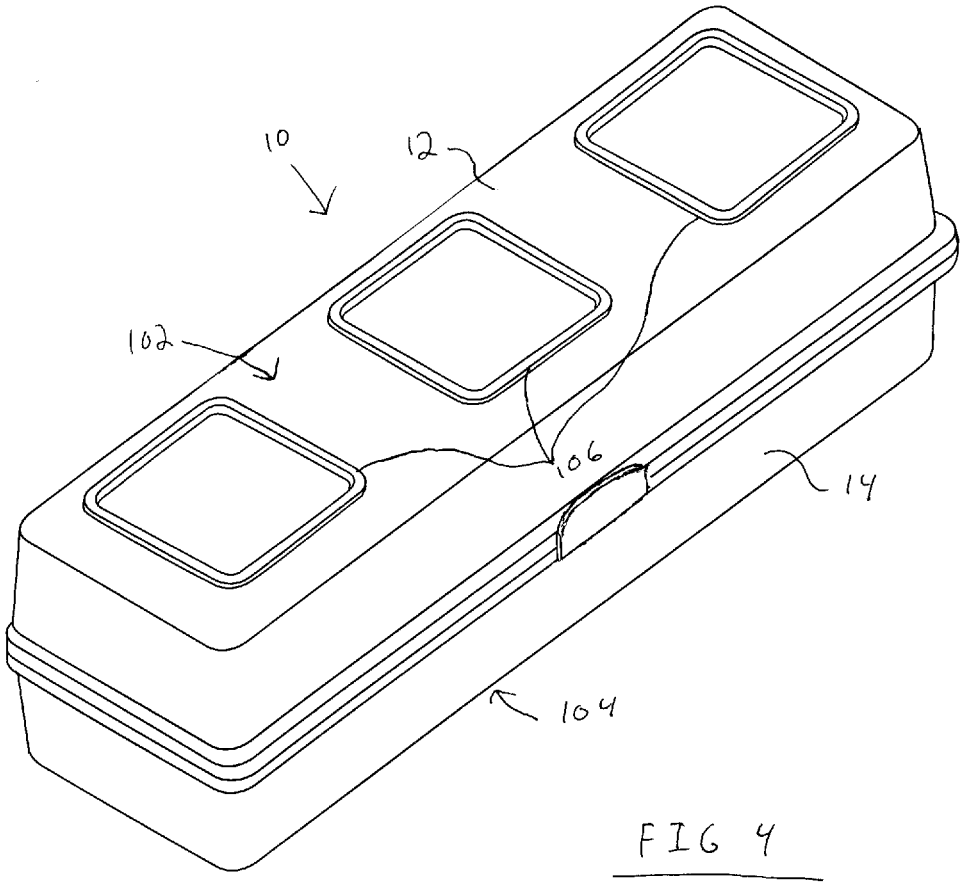
FIG. 4 is a perspective view showing the bottom of the case.
Figure 5:
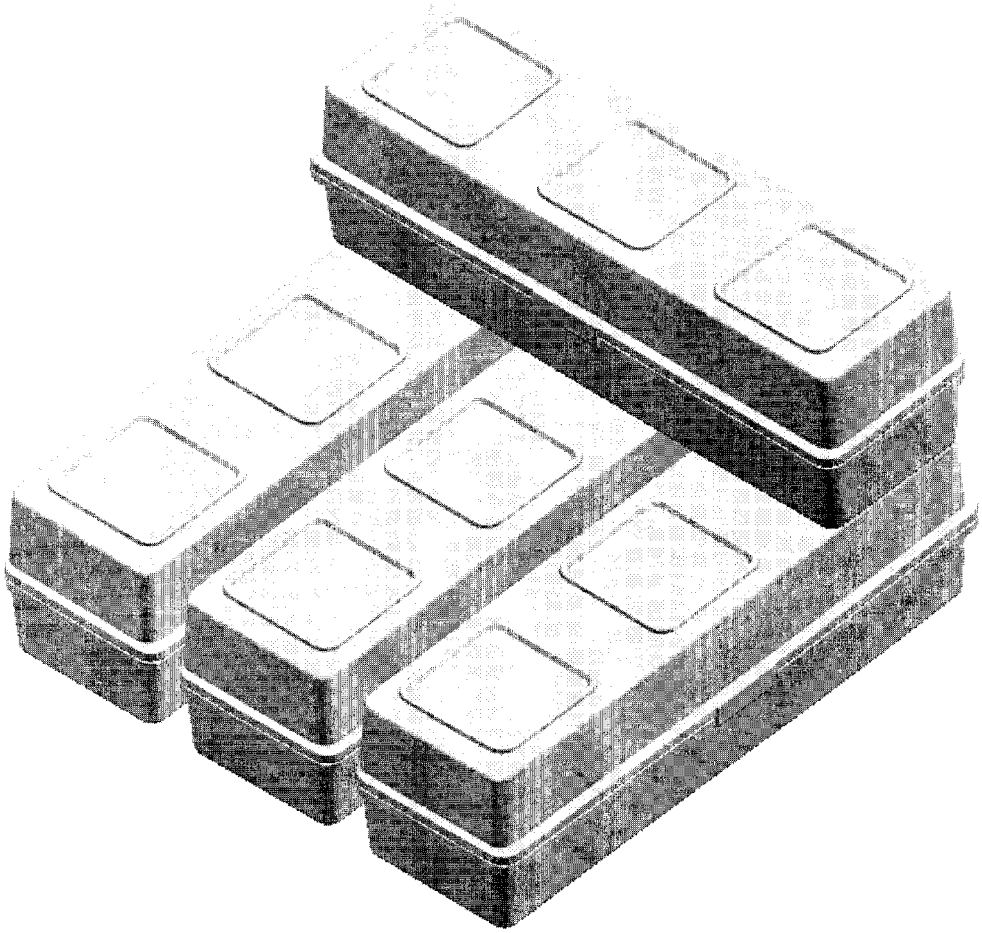
FIGS. 5-9 show a perspective view of a stack of the described cases being constructed.
Figure 6:
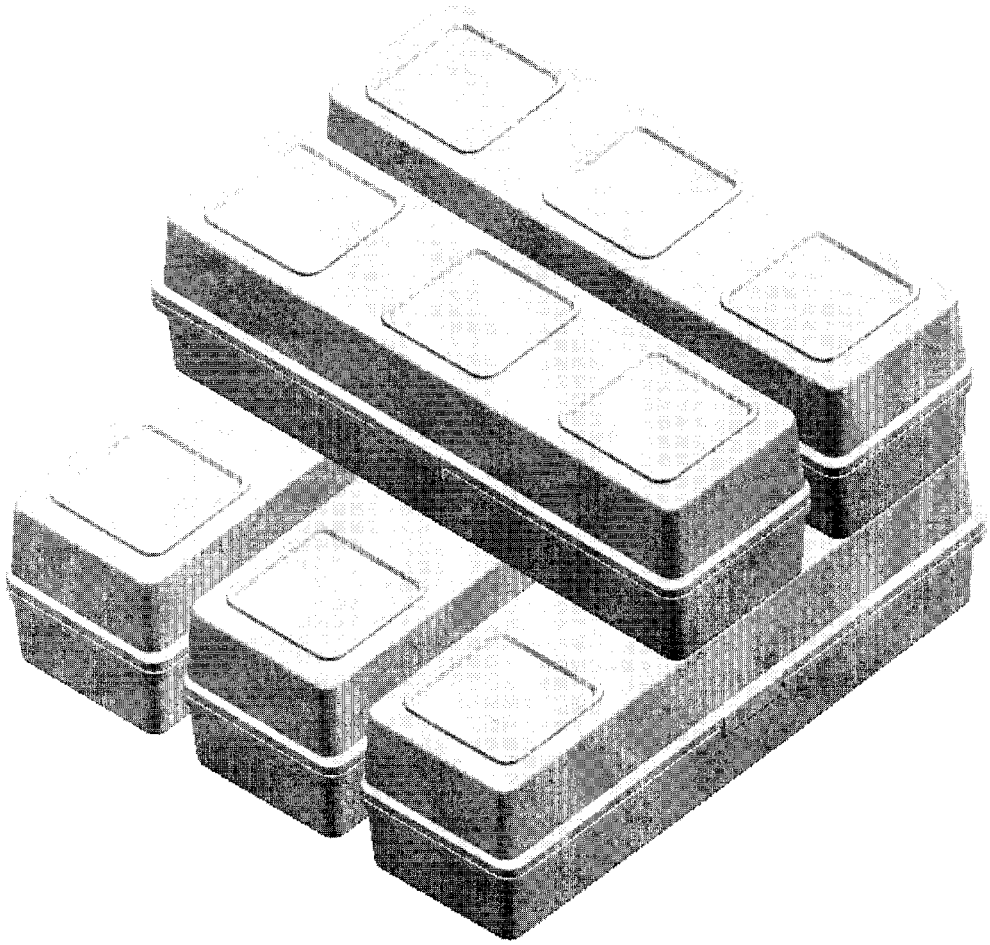
Figure 7:
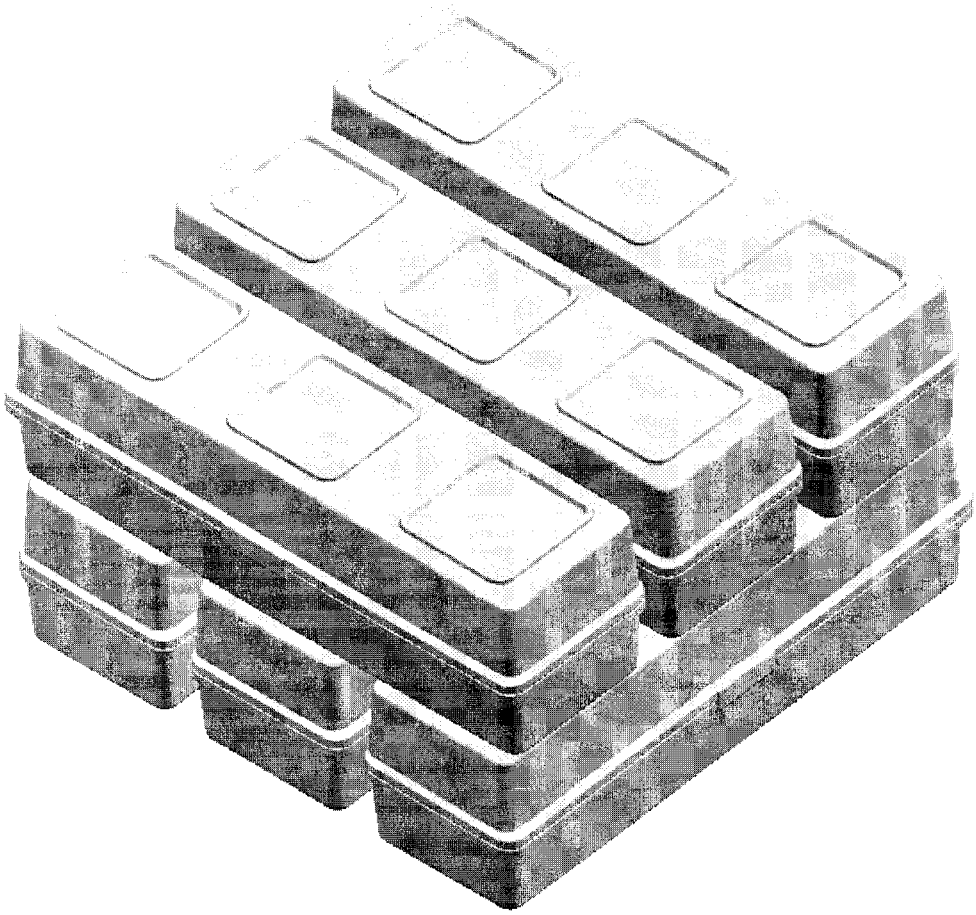
Figure 8:
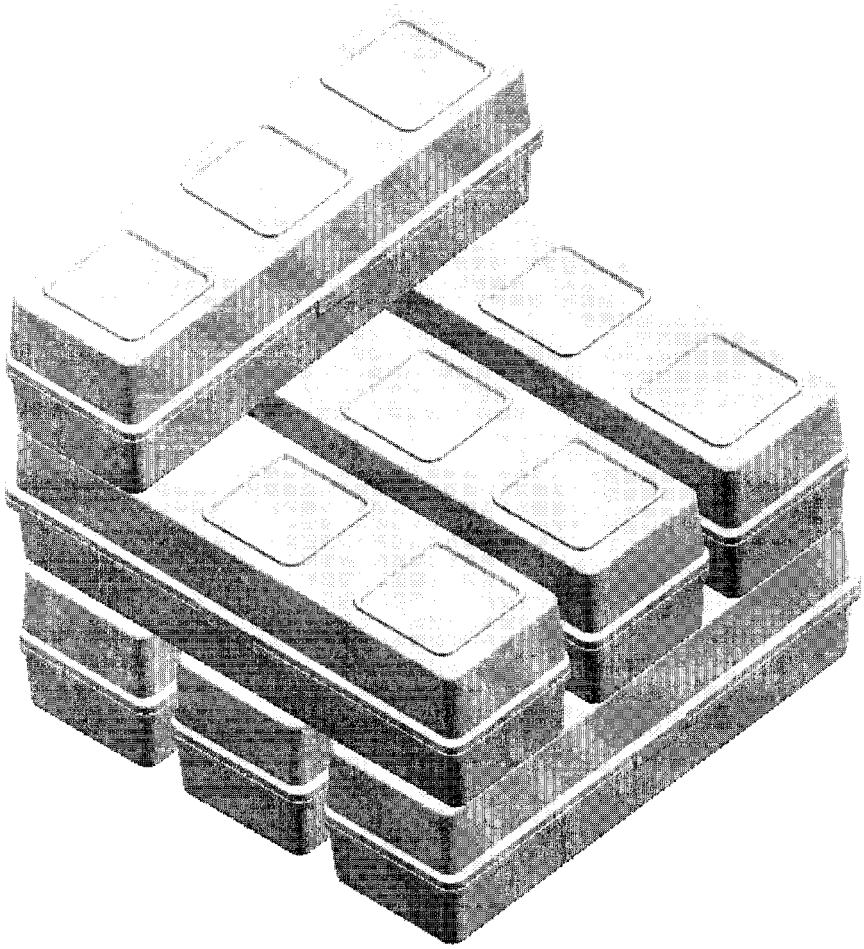
Figure 9:
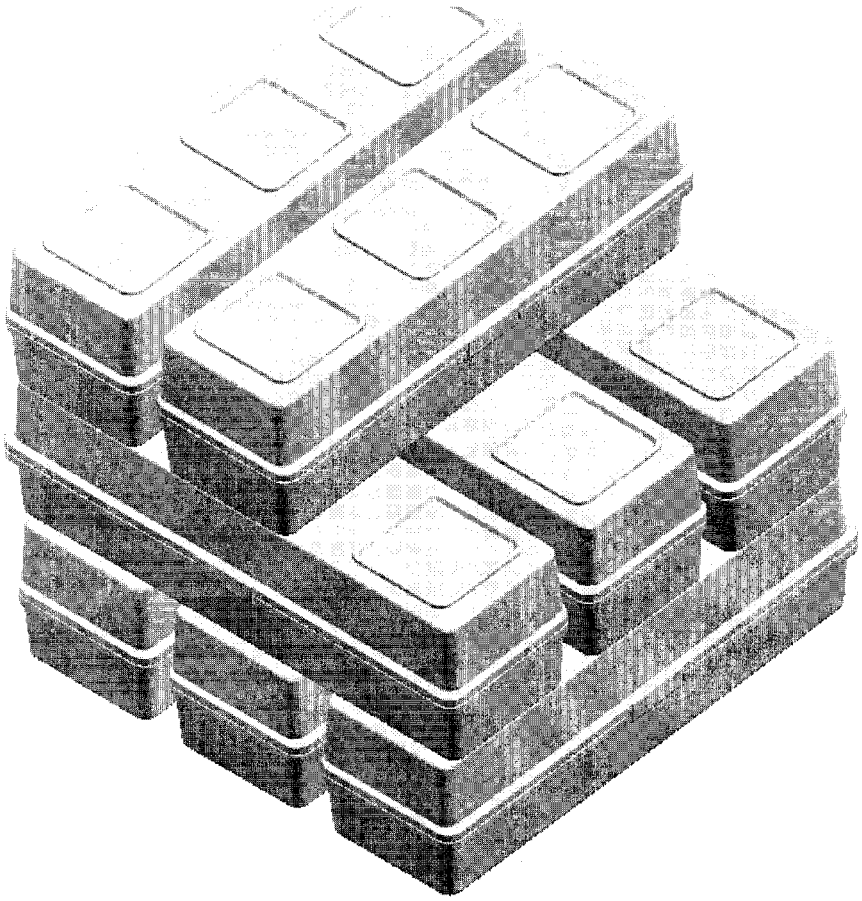

FIGS. 3 and 4 show an example of the case with the lid 14 in a closed position with respect to the case body 12. In FIG. 3 the case is shown in an upright position with the lid on top of the case body. In FIG. 4 the case is shown in an upside down position with the case body on top of the lid. As shown in FIG. 3, the case lid 14 includes a top outer surface 104. As shown in FIG. 4, the case body 12 includes a bottom outer surface 102.

In an exemplary embodiment both the bottom outer surface 102 of the case body and the top outer surface 104 of the case lid include features 106, 108 which enable the surfaces to co-operatively engage respectively with at least two bottom outer surfaces and at least two top outer surfaces of further cases placed above and under the case in stacked relation.

In the described exemplary embodiment, both the top outer surface 104, and the bottom outer surface 102 include a set of three of the interlocking features 106, 108. As a result a first case is operative to interlock with three further cases above it and three further case below it which have been rotated 90 degrees about a vertical axis with respect to the first case. With this arrangement a multi-row stack of the described cases may be built with three cases in each row. FIGS. 5-9 show a plurality of the described case being stacked together in this manner.

In this described embodiment, the interlocking features correspond to raised male and female elements which when engaged with one case on top of another, are operative to resist side to side movement of the cases with respect to each other. In this described embodiment, the interlocking features correspond to projecting walls which extend outwardly and normal to the top outer surface 104 and bottom outer surface in a pattern such as a square with rounded corners.

To enable the projecting walls to interlock, the pattern of the projecting walls 108 on the top outer surface 104 of the lid may be relatively larger (or smaller) than the pattern of the projecting walls 106 on the bottom outer surface 102 of the case body.

Figure 10:
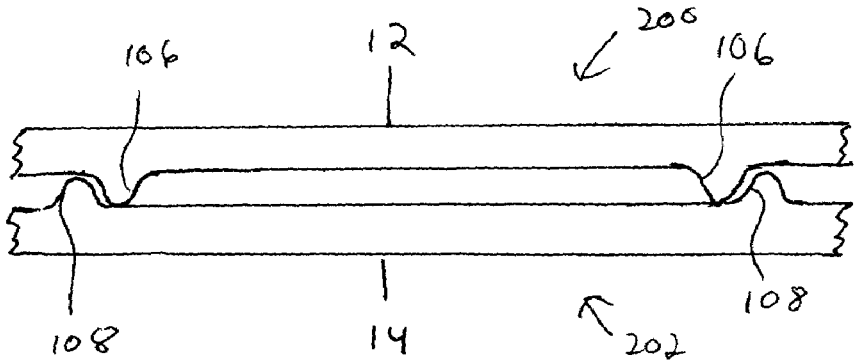
FIG. 10 is a cross-sectional view of two cases in stacked engagement.

For example, FIG. 10 shows a cross-sectional view of two cases with projecting walls 106 on the upper case 200, which extend between the projecting walls 108 of the lower case 202. In this described embodiment, the projecting walls on the lower case have a pattern (e.g. a square pattern) which is smaller than the pattern of the projecting walls on the upper case. As a result, the projecting walls of the lower case extend inside the projecting walls of the upper case.

However, it is to be understood that in alternative embodiments, the interlocking features may include other shapes and configurations which enable the top outer surface of one case to interlock with the bottom outer surface of another case when placed in stacked arrangement. For example, rather than both the top and bottom outer wall surfaces of a case including projecting walls, one of the top or bottom outer surfaces may instead include a recessed portion with a shape that is operative to receive the projecting portion of the other of the top or bottom surfaces of another case thereon and/or thereunder. As used herein, the interlocking features may correspond to any interlocking features which enable cases stacked on top of each other to co-operatively engage with each other.

As shown in FIG. 1, in an embodiment, the divider accepting slots 24 may be positioned such that the individual chips of a stack of chips 50 cannot extend into the slots. For example, to form the divider accepting slots, an embodiment may include a plurality of parallel projections such as partitions 204 located at the interface (e.g., corner) between each inner side surface 32, 34 and the inner bottom surfaces 36 of the cavity. The space between the partitions 204 may correspond to the described divider accepting slots 24. In this described embodiment, the partitions 204 may have a triangular shape. In other embodiments the partitions may have other shapes, depending on the configuration of the inner wall surfaces of the cavity. Also in this described embodiment, the partitions may be sufficiently small such that they do not extend outwardly from the cavity surfaces far enough to extend between chips placed in the cavity.

Figure 11:
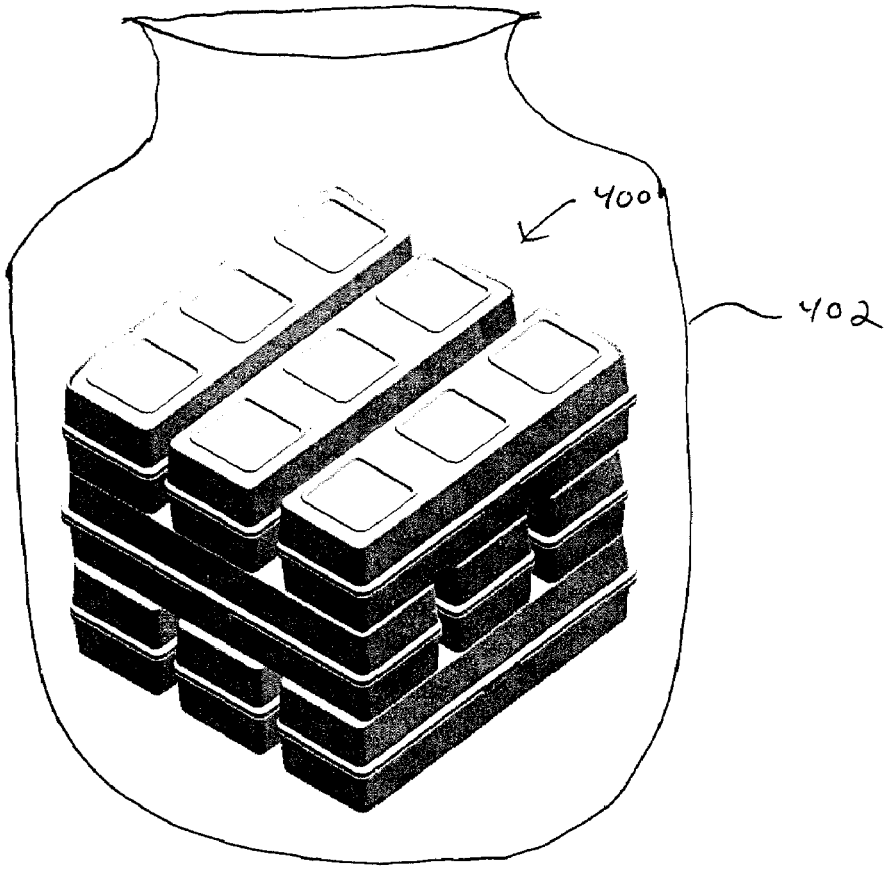
FIG. 11 is a schematic view showing a stack of cases located within a flexible bag.

As shown in FIG. 11, in an exemplary embodiment, a plurality 400 of the described cases stacked with multiple rows of multiple cases in each row (e.g., three cases per row stacked at least three cases high) may be transported within a flexible bag 402 or other container. When transported in this manner, the interlocking features of the cases along with the encasing pressure of the flexible walls of the bag may be sufficient to prevent the stack from falling apart. In addition, the bag may have additional interior space to hold additional items used during a card game such as a poker tournament. Such additional items transported in the bag along with the stack of cases may include decks of playing cards, sunglasses, and/or other poker tournaments items.

Figure 12:
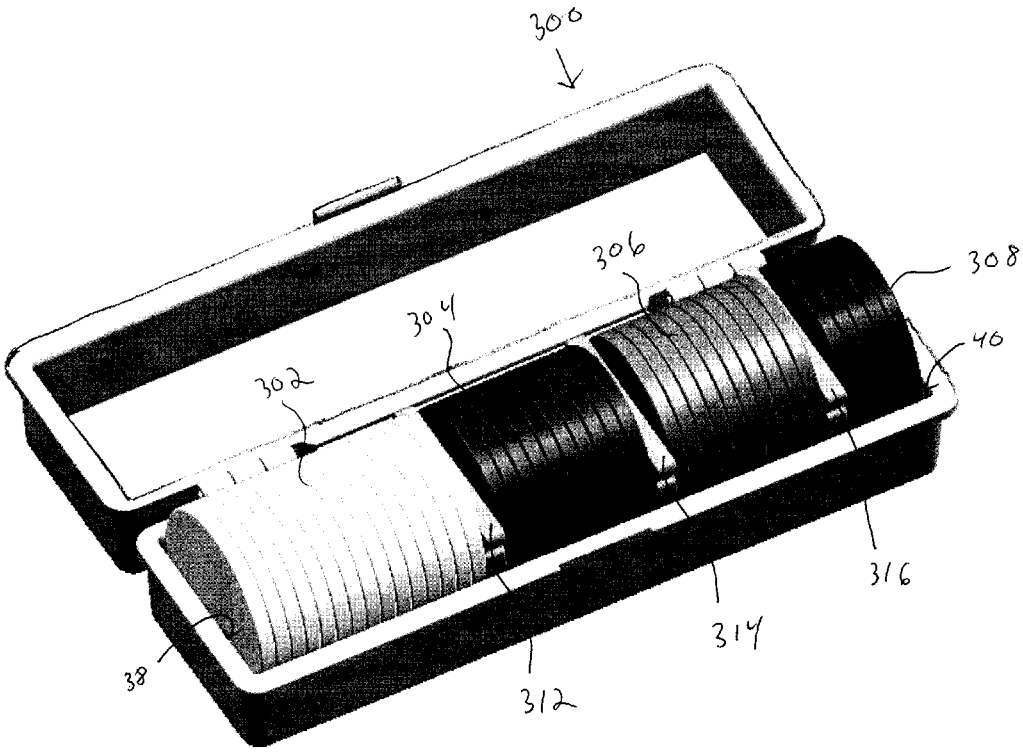
FIG. 12 shows an example configuration of dividers and chips in a case.

FIG. 12 shows an example of how a case 300 may be organized for use with a poker tournament. As shown in FIG. 12, the case may include four stacks 302, 304, 306, 308 of chips separated by three dividers 312, 314, 316. Each stack of chip may be of a different color and/or have other visually distinguishable features.

To decrease the time it takes to fill each case with the same number and type of chips for use during a poker tournament or other card game, an embodiment may include a method of inserting the dividers into a plurality of the described cases prior to inserting the stacks of chips. In this embodiment, each divider may be placed in a predetermined divider accepting slot which is operative to produce spaces between the dividers 321, 314, 316 and/or inner end wall 38, 40 of the cavity which are operative to accept a predetermined maximum number of chips. With each of the cases configured with dividers in the same pattern, the respective spaces between the dividers and the inner end walls of the cavity may be filled with a maximum number of chips of the predetermined respective type of chip. Because the respective sets of spaces in the cavities have the same lengths from case to case, the number of maximum chips used to fill the respective set of spaces in each case will be the same number from case to case. As a result, each case can be quickly filled with the correct number of each type of chip without counting the individual chips.

In an alternative exemplary embodiment, to assist with inserting the dividers in common positions in multiple cases, at least one inner side wall of the cases may include labels or markings adjacent some or all of the divider accepting slots 24, 26. For example, each slot may be numbered on one or both of the inner side walls 32, 34. As a result, to configure multiple cases uniformly for a poker tournament, the dividers may be placed in the same numbered divider slots for each case. After the dividers have been inserted, chips of the correct type (e.g., color) may be placed in the spaces formed by the dividers.

In an exemplary embodiment, the described cases can be configured with the appropriate dividers and stacks of different colored chips well in advanced of poker tournament. On the date of the tournament, cases may be transported to the location of the tournament in the stacked arrangement shown above in FIGS. 5-9. For example, the stack of cases may be carried in the described bag shown in FIG. 11, or in some other carrier such as a box. At the poker tournament location, one or more cases (depending on the tournament and the size of the cases) may be issued to each of the respective players without any need to remove and recount the chips from the cases. As a result, the described cases enable a card playing tournament to be quickly set up with each player receiving the correct predetermined amount of each type of chip.

Thus the new stackable poker chip case and method achieves one or more of the above stated objectives, eliminates difficulties encountered in the use of prior devices and systems, solves problems and attains the desirable results described herein.

In the foregoing description, certain terms have been used for brevity, clarity and understanding; however, no unnecessary limitations are to be implied therefrom, because such terms are used for descriptive purposes and are intended to be broadly construed. Moreover, the descriptions and illustrations herein are by way of examples, and the invention is not limited to the exact details shown and described.

In the following claims, any feature described as a means for performing a function shall be construed as encompassing any means known to those skilled in the art to be capable of performing the recited function, and shall not be limited to the features and structures shown herein or mere equivalents thereof. The description of the exemplary embodiment included in the Abstract included herewith shall not be deemed to limit the invention to features described therein.

Having described the features, discoveries and principles of the invention, the manner in which it is constructed and operated, and the advantages and useful results attained; the new and useful structures, devices, elements, arrangements, parts, combinations, systems, equipment, operations, methods and relationships are set forth in the appended claims.

We claim:

1. An apparatus comprising:

at least one first case including:

a case body, wherein the case body includes:

a cavity, wherein the cavity includes therein:

at least one cavity wall;

a plurality of divider accepting slots spaced apart along the at least one cavity wall;

wherein the cavity is operative to support a plurality of poker chips therein in stacked relation;

an opening to the cavity;

a bottom outer surface;

at least one case lid operative to close the opening to the cavity, wherein the at least one case lid includes:

a top outer surface;

wherein the top outer surface and the bottom outer surface include interlocking features which are operative to co-operatively engage respectively with at least two bottom outer surfaces and at least two top outer surfaces of further cases placed above and under the at least one first case in stacked relation;

at least one divider operative to slide into any one of the plurality of divider accepting slots.

2. The apparatus according to claim 1, wherein the case body includes at least one set of a plurality of spaced apart projections in operative connection with the at least one cavity wall, wherein each slot extends between adjacent pairs of the spaced part projections.

3. The apparatus according to claim 2, wherein the cavity includes a bottom inner surface, wherein the case body includes two sets of the plurality of spaced apart projections, wherein the two sets are positioned on opposed sides of the bottom inner surface, wherein the divider accepting slots in the two sets of projections are aligned, such that the divider is capable of sliding into aligned pairs of the divider accepting slots positioned on opposed sides of the bottom surface.

4. The apparatus according to claim 3, wherein the projections are positioned in the cavity such that a circular poker chip is not capable of sliding into the divider accepting slots.

5. The apparatus according to claim 1, wherein the interlocking features of the top outer surface are operative to co-operatively engage with the bottom outer surfaces of at least two cases placed in side by side relation on top of the at least one case lid, wherein the interlocking features of the bottom outer surface are operative to co-operatively engage with the top outer surfaces of at least two cases placed in side by side relation under the case body.

6. The apparatus according to claim 1, comprising;

at least three pairs of the cases in stacked relation, wherein for each pair of cases, the cases are position in side by side relation, wherein each pair of cases is stacked below or above at least one other pair of cases, wherein each pair of cases is rotated 90 degrees about a vertical axis with respect to the pair of cases at least one of immediately thereabove and immediately therebelow.

7. The apparatus according to claim 1, comprising:

at least three sets of three cases in stacked relation, wherein for each set of three cases, the three cases are position in side by side relation, wherein each set of three cases is stacked below or above at least one other set of three cases, wherein each set of three cases is rotated 90 degrees about a vertical axis with respect to the set of three cases at least one of immediately thereabove and immediately therebelow.

8. The apparatus according to claim 7, further comprising a flexible bag, wherein the at least three sets of three cases in stacked relation are positioned inside the bag, wherein each case includes at least one stack of poker chips, wherein at least one case includes at least two stacks of poker chips, wherein the at least two stacks of poker chips are separated by the at least one divider.

9. The apparatus according to claim 1, wherein the interlocking features include at lease one raised portion, wherein the interlocking features include at least one recessed portion, wherein the at least one raised portion of the at least one first case is operative to project in at least one recessed portion of at least one other case.

10. The apparatus according to claim 1, wherein the interlocking features include at least one raised projection, wherein the at least one raised portion of the at least one first case is operative to resist lateral movement of at least one raised portion of at least one other case stacked at least one of below or on top of the at least one first case.

11. A method comprising:

a) providing a plurality of cases, wherein each case includes:

a case body, wherein the case body includes:

a cavity, wherein the cavity includes therein:

at least one cavity wall;

a plurality of divider accepting slots spaced apart along the at least one cavity wall, wherein the cavity is operative to support a plurality of poker chips therein in stacked relation;

an opening to the cavity;

a bottom outer surface;

at least one case lid operative to close the opening to the cavity, wherein the case lid includes:

a top outer surface;

b) for at least one case, inserting at least one divider into a slot;

c) inserting at least one stack of poker chips into each case; and d) stacking at least three pairs of the cases to form a stack of cases, wherein for each pair of cases, the cases are position in side by side relation, wherein each pair of cases is stacked below or above at least one other pair of cases, wherein each pair of cases is rotated 90 degrees about a vertical axis with respect to the pair of cases at least one of immediately thereabove and immediately therebelow.

12. The method according to claim 11, wherein in (d), the top outer surface and the bottom outer surface of each case include interlocking features which are operative to co-operatively engage respectively with at least one bottom surface and at least one top outer surface of further cases placed immediately thereabove or immediately therebelow.

13. The method according to claim 12, wherein at least one of the slots in each case is positioned a first distance from at least one end of the case body, wherein (b) includes, for each one of at least two cases, inserting at least one divider into the slot positioned the first distance from the at least one end of the respective case body, wherein (c) includes inserting a stack of poker chips on each side of the divider in the at least two cases, wherein the chips on one side of the divider include chips of a different color than chips on a second side of the divider.

14. The method according to claim 13, further comprising:

e) transporting the cases as a stack to a poker game location.

15. The method according to claim 14, wherein the poker game location includes a plurality of poker players, further comprising:

f) issuing at least one case to each poker player, wherein the cases issued include the at least two cases.

16. The method according to claim 15, further comprising:

g) playing at least one game of poker at the poker game location, including removing at least one chip from the cases issued in (f).

17. The method according to claim 16, wherein (a) through (d) are carried out in at least one location remote from the poker game location.

18. The method according to claim 16, wherein in (f) the at least two cases are issued to respective players before any of the chips in the at least two cases are removed from the at least two cases at the poker game location.

19. The method according to claim 12, wherein (d) includes stacking at least three sets of three cases in stacked relation, wherein for each set of three cases, the three cases are positioned in side by side relation, wherein each set of three cases is stacked below or above at least one other set of three cases, wherein each set of three cases is rotated 90 degrees about the vertical axis with respect to the set of three cases at least one of immediately thereabove and immediately therebelow.

20. The apparatus according to claim 19, further comprising:

e) placing the cases as a stack into a bag; and f) transporting the cases as a stack inside the bag to a poker game location.

* * * * *